US006443105B2

(12) United States Patent
Oishi

(10) Patent No.: US 6,443,105 B2
(45) Date of Patent: Sep. 3, 2002

(54) RADIATOR FAN CONTROLLER

(75) Inventor: Hiroshi Oishi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/845,974

(22) Filed: Apr. 30, 2001

(30) Foreign Application Priority Data

May 9, 2000 (JP) ..... 2000-136206

(51) Int. Cl.[7] ..... F01P 7/02
(52) U.S. Cl. ..... 123/41.12
(58) Field of Search ..... 123/41.12, 41.49, 123/41.01, 41.02, 41.65

(56) References Cited

U.S. PATENT DOCUMENTS 4,168,456 A * 9/1979 Isobe ..... 123/41.12
4,977,862 A * 12/1990 Aihara et al. ..... 123/41.12
5,018,484 A * 5/1991 Naitoh ..... 123/41.12
5,133,302 A * 7/1992 Yamada et al. ..... 123/41.12
5,848,366 A * 12/1998 Ueda ..... 701/36

FOREIGN PATENT DOCUMENTS

JP 61145315 A * 7/1986 ..... 123/41.02
JP 598963 4/1993

* cited by examiner

*Primary Examiner*—Gene Mancene
*Assistant Examiner*—Hyder Ali
(74) *Attorney, Agent, or Firm*—Martin A. Farber

(57) ABSTRACT

A radiator fan controller is provided for lowering temperature in an engine compartment by positively scavenging it if the compartment is hot enough to require scavenging. Coolant temperature Tw is compared with a high temperature determining threshold value TWS. In the case of Tw<TWS, vehicle speed VSP is compared with a low speed determining threshold value VSPS. In the case of VSP<VSPS, intake air temperature Ta is compared with an intake air temperature determining threshold value TAS. In the case of VSP<VSPS and Ta≧TAS, it is determined that scavenging by running wind cannot lower the temperature and a radiator fan should be forcibly turned on. As a result, the engine compartment is forcibly scavenged by blowing air from the radiator fan to prevent respective components from suffering thermal damage caused by excessively rising temperature.

5 Claims, 3 Drawing Sheets

RADIATOR FAN CONTROLLER

BACKGROUND OF THE INVENTION

The present invention relates to a radiator fan controller for preventing the generation of an excessive temperature rise by scavenging an engine compartment.

A conventional cooling system for a water-cooled engine mounted on a motor vehicle circulates a coolant which has become hot after cooling the engine by an radiator to cool the coolant therein and supplies it to the engine again, and is provided with a motor-driven radiator fan to accelerate heat exchange in the radiator. The motor-driven radiator fan is generally controlled by combining various parameters, such as vehicle speed and the operating conditions of an air conditioner, with the temperature of coolant as a main condition, as disclosed in Japanese Patent Application Laid-Open Publication No. Hei. 5-98963.

Such a conventional radiator control, however, only cools a condenser of an air conditioner as long as it becomes hot, and controls the operation of a radiator fan, basically, in order to maintain the coolant temperature of an engine properly. Therefore, even if the temperature in an engine compartment becomes high at the time of idling immediately after heavy load driving, for example, pulling a heavy cargo, such as a leisure boat or an engine stalled vehicle, or hill climbing, or low-speed driving due to traffic congestion, a radiator fan will not operate unless the temperature of coolant rises to higher temperature than a predetermined value.

Under such situations, ambient temperature in the engine compartment is sometimes excessively high although the coolant temperature of the engine is maintained properly, so that various types of components disposed in the engine compartment constituted of a material such as rubber or resin may have thermal effects, thus causing the degradation of durability thereof. Therefore, a conventional method of maintaining the temperature in the engine compartment properly has requited some measures such as the addition of a new apparatus for forcibly scavenging the engine compartment.

SUMMARY OF THE INVENTION

It is therefore an object of the present invention to provide a radiator fan controller which is capable of lowering the temperature in the engine compartment by positively scavenging the engine compartment if the temperature in the engine compartment is high enough to require scavenging.

In accomplishing the foregoing object, according to a first aspect of the invention, a radiator fan controller comprises engine compartment temperature determining means for determining an engine compartment temperature state as a high temperature state requiring scavenging of an engine compartment when the temperature in the engine compartment is equal to or higher than a predetermined temperature level under a lower vehicle speed than a predetermined speed level, or under a stopping state, and engine compartment scavenging means for scavenging the engine compartment by operating a radiator fan when the above-mentioned determining means determines the temperature in the engine compartment as being high enough to require scavenging of the engine compartment.

According to a second aspect of the invention, a radiator fan controller for operating a radiator fan when a coolant temperature is equal to or higher than a predetermined level, comprises engine compartment temperature determining means for determining an engine compartment temperature state as a high temperature state requiring scavenging of an engine compartment when the temperature in the engine compartment is higher than a predetermined temperature level and when a vehicle speed is lower than a predetermined speed level, or under a stopping state, and engine compartment scavenging means for scavenging the engine compartment by operating the radiator fan for a predetermined period of time once the above-mentioned determining means determines the temperature in the engine compartment as being high enough to require scavenging of the engine compartment regardless of coolant temperature, vehicle speed, or engine compartment temperature sensed for a predetermined period of time.

In other words, the first aspect of the invention positively prevents various types of components disposed in the engine compartment from having thermal damage being suffered from the high temperature in the engine compartment by operating the radiator fan to scavenge the engine compartment when the temperature in the engine compartment is equal to or higher than a predetermined temperature level under a low-speed driving condition that vehicle speed is lower than a predetermined speed level, or a stopping condition.

The second aspect of the invention positively prevents various types of components disposed in the engine compartment from having thermal damage being suffered from the high temperature in the engine compartment by operating the radiator fan under a condition that the engine coolant temperature is equal to or higher than the predetermined level, and through scavenging the engine compartment by operating the radiator fan regardless of coolant temperature, vehicle speed, or engine compartment temperature for a predetermined time once the temperature in the engine compartment is determined to be equal to or higher than a predetermined temperature level under such a low-speed driving state that vehicle speed is equal to or lower than a predetermined speed level, or a stopping state to maintain the coolant temperature properly and lower the temperature in the engine compartment.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Figure 1:
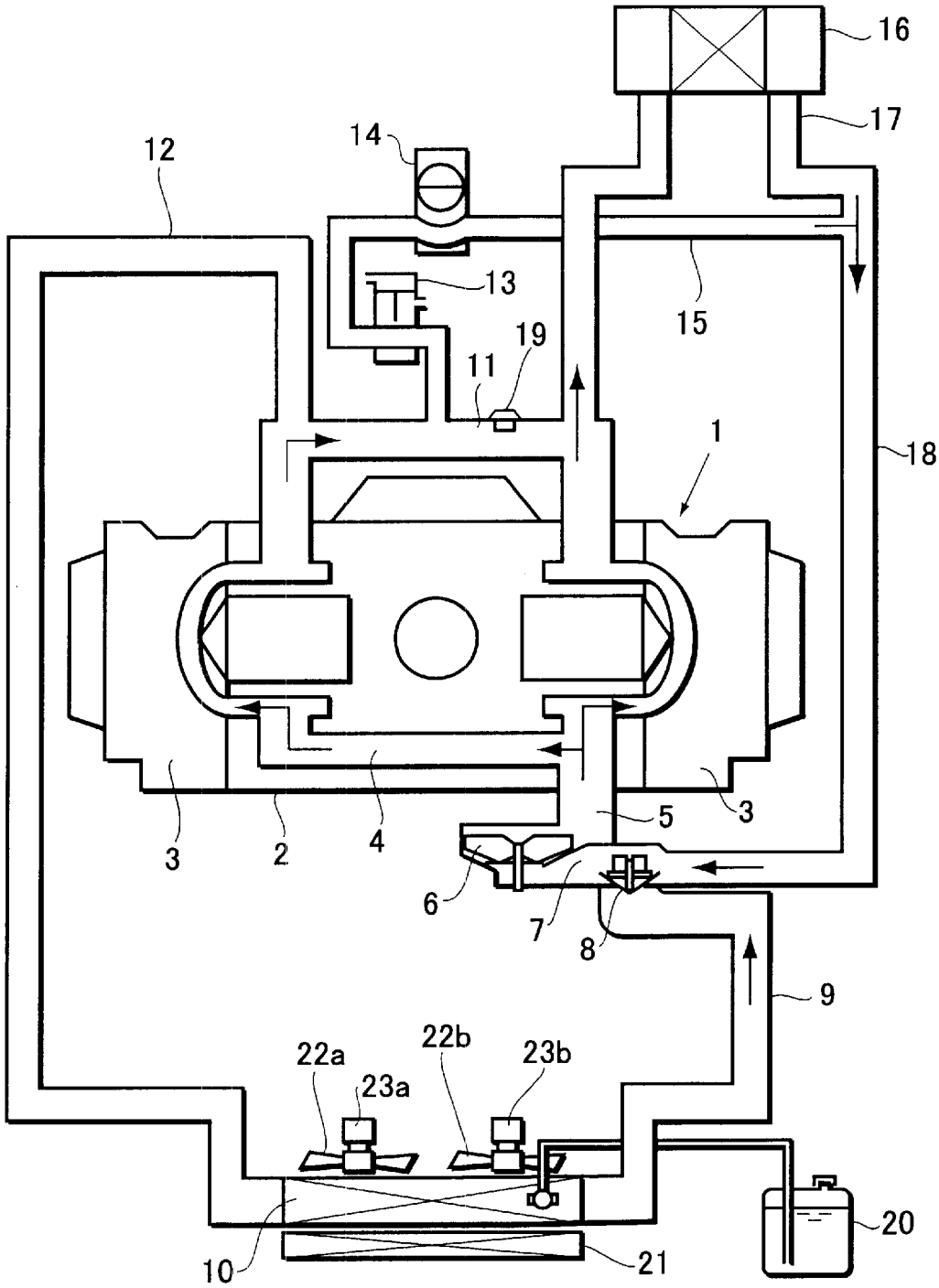
FIG. 1 is a schematic structural diagram of an engine cooling system in the present invention.
Figure 2:
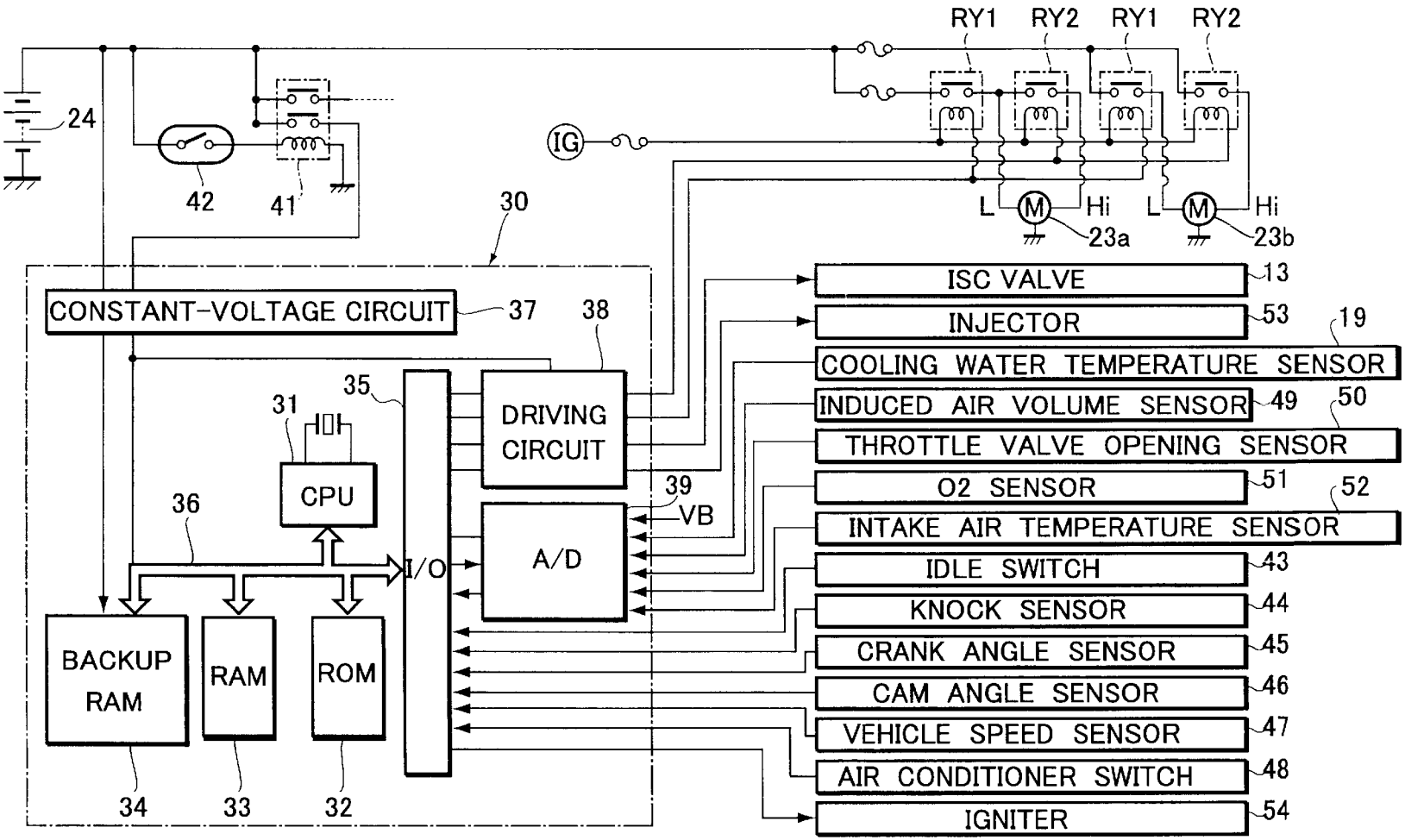
FIG. 2 is a circuit diagram of an electronic controlling system in the present invention.
Figure 3:
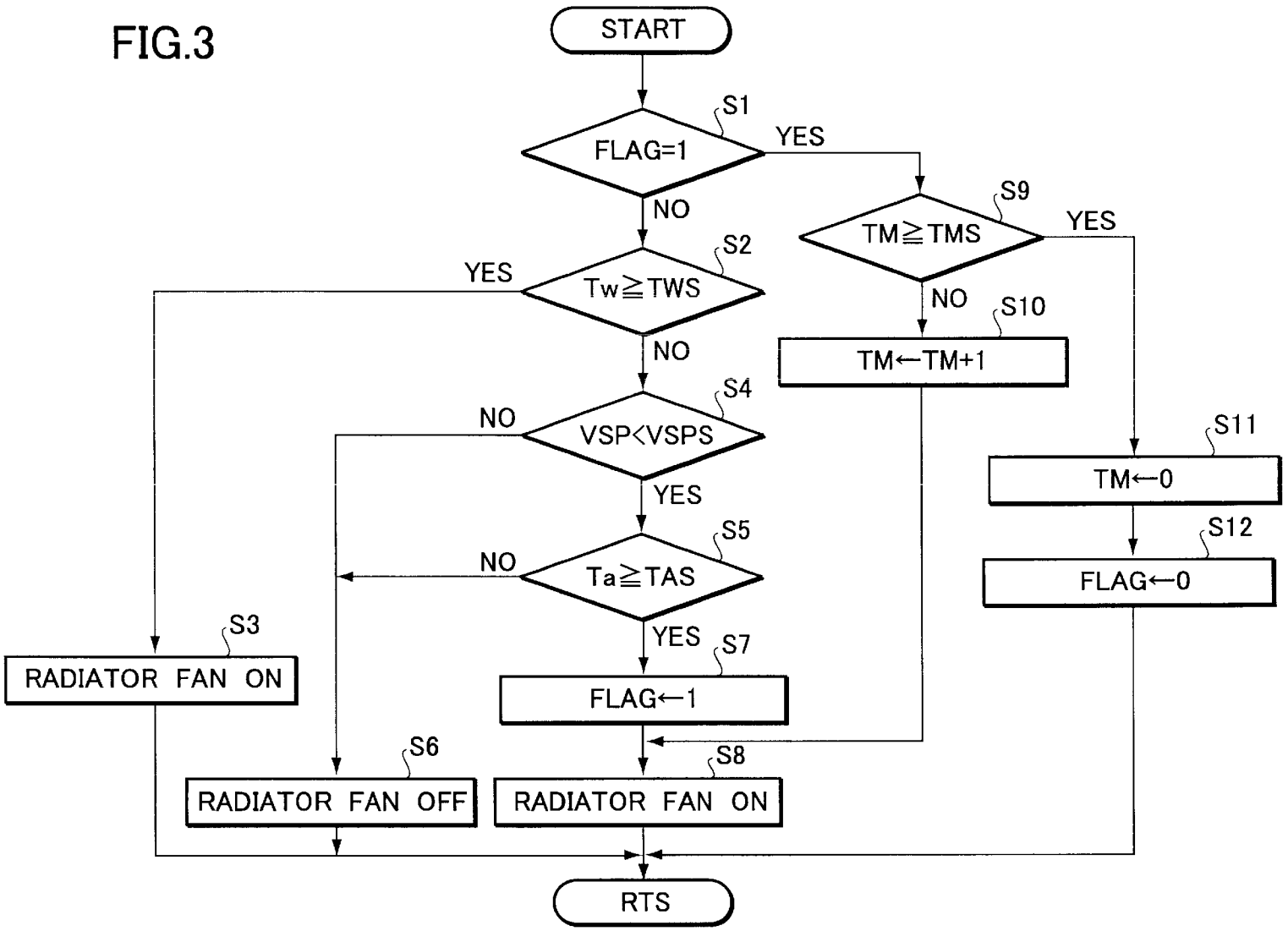
FIG. 3 is a flow chart showing a radiator fan control routine in the present invention.

Embodiments of the present invention will be described in detail with reference to the accompanying drawings. FIGS. 1 through 3 show a first embodiment of the present invention. FIG. 1 is a schematic structural block diagram of an engine cooling system. Reference numeral 1 denotes a water-cooled engine for a vehicle such as a motorcar, and is a horizontally opposed engine in this embodiment of the present invention. A water jacket 4 is formed on a cylinder block 2 and cylinder heads 3 of the right and left banks of the engine 1, and the discharge side of a water pump 6 is connected to a coolant inlet 5 of the water jacket 4. A thermostat 8 is disposed at a suction passage 7 of the water pump 6, and an inlet side of the thermostat 8 is connected to a radiator 10 through a coolant passage 9.

A junction passage 11 is connected to the water jacket 4 from the respective banks above the engine 1 so that they may communicate with each other. A return passage 12 communicating with the radiator 10 is connected to the junction passage 11. A coolant passage 15 for intake air preheating and a coolant passage 17 for heater are connected to the junction passage 11. The coolant passage 15 is provided with an idle speed control valve (ISC valve) 13 and a throttle body 14, and the coolant passage 17 is provided with a heater 16. The coolant passages 15, 17 merge with a circulating passage 18 and are connected to the suction passage 7 (the outlet side of a thermostat 8) of the water pump 6. At the junction passage 11 where coolant from the respective banks merges, a coolant temperature sensor 19 is disposed which detects the temperature of the coolant from the engine 1.

In this embodiment, a down flow system is adopted. Here, coolant is allowed to flow through the passages 15, 17 and the circulating passage 18 with the thermostat 8 closed when coolant is at a low temperature, whereas the thermostat 8 is opened with rising coolant temperature, and sends the coolant cooled by the radiator 10 out to the water jacket 4 of the engine 1 from a lower side of the engine 1 using the water pump 6 in addition to the circulation of the coolant, thereby returning the coolant heat-exchanged by the water jacket 4 to the radiator 10 from an upper side of the engine 1.

A reserve tank 20 storing the coolant overflowing from the radiator 10 is connected to the radiator 10. A condenser 21 for an air conditioner is disposed in front of the radiator 10, and two radiator fans 22*a*, 22*b* for cooling the radiator 10 and the condenser 21 by suction and blowing operations are disposed behind the radiator 10. The radiator fans 22*a*, 22*b* are driven by electric motors 23*a*, 23*b*, respectively.

As shown in FIG. 2, the electric motors 23*a*, 23*b* are provided with a HIGH input terminal Hi and a LOW input terminal L for controlling the rotational speeds of the radiator fans 22*a*, 22*b* in two levels of HIGH and LOW, respectively. The power voltage from a battery 24 is applied to the HIGH input terminal Hi through a relay RY2 for HIGH and to the LOW input terminal L through a relay RY1 for LOW, respectively.

The respective relay RY1 for LOW and relay RY2 for HIGH are ON/OFF controlled by an electronic control unit 30, respectively. With both the relay RY1 for LOW and the relay RY2 for HIGH turned OFF, both the input terminals Hi, L of the electric motors 23*a*, 23*b* are shut down from a power source, so that the electric motors 23*a*, 23*b* stop, and thus the radiator fans 22*a*, 22*b* fixed on output shafts of the electric motors 23*a*, 23*b* also stop.

When only the relay RY1 for LOW is ON, power supply voltage is applied to only the LOW input terminal L of the electric motors 23*a*, 23*b*, and the radiator fans 22*a*, 22*b* are driven at a predetermined low speed. When both the relays RY1, RY2 are ON, power supply voltage is applied to both the input terminals Hi, L of the electric motors 23*a*, 23*b*, the radiator fans 22*a*, 22*b* are driven at a predetermined high speed.

Referring next to FIG. 2, the electronic control unit (ECU) 30 will be described. The ECU 30 is mainly composed of a microcomputer including a CPU 31, a ROM 32, a RAM 33, a backup RAM 34, and an I/O interface 35, which are connected to each other through a bus line 36. The ECU 30 further includes peripheral circuits such as a constant-voltage circuit 37 for supplying stabilized power supply to respective parts, a driving circuit 38 connected to the I/O interface 35, and an A/D converter 39.

The constant-voltage circuit 37 is connected to the battery 24 through the first relay contact of a power supply relay 41 having two-circuit relay contacts, and a relay coil of the power supply relay 41 is connected to the battery 24 through an ignition switch 42. The constant-voltage circuit 37 is connected directly to the battery 24, and when the ignition switch 42 is ON and the contact of the power supply relay 41 is closed, power is supplied to respective parts in the ECU 30. On the other hand, backup power is always supplied to the backup RAM 34, whether the ignition switch 42 is ON or OFF. A power line for supplying power is connected to respective actuators through the second relay contact of the power supply relay 41.

To the input port of the I/O interface 35, an idle switch 43, a knock sensor 44, a crank angle sensor 45, a cam angle sensor 46, a vehicle speed sensor 47, and an air conditioner switch 48 are connected as sensors and switches for detecting engine running conditions or the like. The idle switch 43 is used to detect the fully closed state of a throttle valve. The knock sensor 44 is used to detect knocking. The crank angle sensor 45 is used to detect engine speed. The cam angle sensor 46 is used to discriminate cylinders. The vehicle speed sensor 47 is used to detect vehicle speed. The air conditioner switch 48 is used to detect the operating state of an air conditioner. To the input port of the I/O interface 35 through the A/D converter 39, are further connected the coolant temperature sensor 19, an induced air volume sensor 49 for detecting induced air volume, a throttle valve opening sensor 50 for detecting a throttle valve opening degree, an O2 sensor 51 for detecting oxygen concentration in exhaust gas, and an induced air temperature sensor 52 for detecting intake air temperature, and also battery voltage VB is inputted to be monitored. Incidentally, the induced air temperature sensor 52 is used to determine a temperature in an engine compartment in radiator fan control described later, and is disposed at any area of an intake system between an air cleaner and an intake manifold.

To the output port of the I/O interface 35, one of the terminals of the relay coil of each relay RY1, RY2 for LOW and HIGH, the ISC valve 13, an injector 53 are connected through the driving circuit 38, and an igniter 54 is also connected thereto. The other of the terminals of the relay coil of each relay RY1, RY2 for LOW and HIGH is connected to an IG terminal of the ignition switch 42.

The ECU 30 executes a control program stored in the ROM 32 by the CPU, and processes detected signals input from sensors and switches and battery voltage VB, and the like through the I/O interface 35. Further, the ECU 30 calculates the fuel injection amount, ignition timing, a duty ratio of drive signal for the ISC valve 13 or the like based on various data stored in the RAM 33, various learning data stored in the backup RAM 34, and fixed data stored in the ROM 32 to perform an engine control such as a fuel injection control, ignition timing control, and idling speed control.

The ECU 30 controls the operating conditions of the radiator fans 22*a*, 22*b* by performing ON/OFF control of the relays RY1, RY2 according to various conditions such as the coolant temperature of the engine 1, vehicle speed, and the operating condition of an air conditioner in addition to the engine control such as fuel injection control and ignition timing control, thereby maintaining the coolant temperature of an engine properly.

The radiator fan control not only maintains coolant temperature properly, but also prevents the temperature in the engine compartment from rising excessively. That is, in case of the radiator fans 22*a*, 22*b* with an inoperative state and unexpectable scavenging of the engine compartment by wind induced through running of the vehicle, forcible operation of the radiator fans 22*a*, 22*b* scavenges the engine compartment to prevent the generation of a thermal effect upon various components made of a material such as rubber or resin in the engine compartment.

To be more specific, the ECU 30 checks whether the radiator fans 22*a*, 22*b* are now operating or not. In the case of the radiator fan with an inoperative state, the ECU 30 compares vehicle speed with a predetermined speed level. In addition, the ECU 30 catches intake air temperature as the temperature in the engine compartment, and compares the intake air temperature with a predetermined temperature. If the vehicle speed is lower than the predetermined speed and the intake air temperature is equal to or higher than the predetermined temperature level, namely, when the intake air temperature is equal to or higher than the predetermined temperature under such conditions as no air blowing into the engine compartment by the radiator fans 22*a*, 22*b* and unexpected scavenging of the engine compartment by the wind, it is determined as being in a high-temperature condition requiring scavenging of the engine compartment to turn on the relays RY1, RY2, operate the radiator fans 22*a*, 22*b* and scavenge the engine compartment positively, thereby preventing generation of an excessive temperature rise in the engine compartment.

In other words, the ECU 30 includes the functions of engine compartment temperature determining means and engine compartment scavenging means, that is, the functions of the respective means are carried out by a routine shown in FIG. 3.

Referring to FIG. 3, a radiator fan control process operated by the ECU 30 will be described with reference to the flow chart showing a radiator fan control routine therein. The radiator fan control routine is a routine which permits a system to be initialized (clearing of respective flags and counters except various types of learning values and trouble data stored in the backup RAM 34) with power supply put to work, and is executed at predetermined time intervals (for example, 10 msec) after the engine is started.

When the radiator fan control routine is executed, first, the value of a radiator fan operating flag FLAG is referred to in Step S1. The radiator fan operating flag FLAG indicates whether or not the radiator fans 22*a*, 22*b* are being operated for scavenging the engine compartment, and indicates radiator fan OFF (inoperative) with flag clear, namely, FLAG=0, and radiator fan ON (operative) with flag set, namely, FLAG=1.

If the radiator fans 22*a*, 22*b* are inoperative with FLAG=0, the coolant temperature Tw detected by the coolant temperature sensor 19 is compared with a high water temperature determining threshold value TWS (e.g. 90° C.) in Step S2. When the coolant temperature is on the higher temperature side with Tw≧TWS, the process proceeds to Step S3 to turn on the radiator fans 22*a*, 22*b*, improve the cooling effect of the coolant by the radiator 10 and completes the routine.

In turning on the radiator fan in Step S3, it is preferable to control the operating conditions of the radiator fans 22*a*, 22*b* so as to be optimum, thereby keeping the coolant temperature of the engine properly, and reducing the power loss of the engine and a noise level. For example, it is determined whether only the relay RY1 should be turned on to operate the radiator fans 22*a*, 22*b* at a low speed, or both the relays RY1, RY2 should be turned on to operate the radiator fans 22*a*, 22*b* at a high speed according to various conditions such as vehicle speed VSP by a vehicle speed sensor 47 or air conditioner operating conditions with air conditioner switch 48 turned on or off.

In operating the radiator fans 22*a*, 22*b* under a high water temperature condition where the coolant temperature Tw is equal to or higher than the high water temperature determining threshold value TWS in the above Steps S2, S3, that is, in the case of ordinary radiator fan control which keeps coolant temperature at a proper temperature, the radiator fan operating flag FLAG is not set, but Step S1 is shifted to Step S2 with FLAG=0 at the time of executing the next routine, and the coolant temperature Tw is compared with the high temperature determining threshold value TWS again. As long as the high water temperature condition of Tw≧TWS is satisfied, the operation of the radiator fans 22*a*, 22*b* is continued under step S3.

If the coolant temperature Tw is not in a high water temperature condition with Tw<TWS in Step S2, it is determined whether the engine compartment is under such a high temperature condition as requires forced scavenging, based on the vehicle speed VSP and an intake air temperature Ta in Steps S4 and S5. That is, the vehicle speed VSP by the vehicle speed sensor 47 is compared with the low speed determining threshold value VSPS at Step S4. In the case of VSP<VSPS, the intake air temperature Ta by the intake air temperature sensor 52 is compared with the intake air determining threshold value TAS in Step S5.

The low speed determining threshold value VSPS and the intake air determining threshold value TAS are predetermined levels for determining whether there exists a high temperature state that scavenging of the engine compartment by the wind is not expected under a low vehicle speed running condition or idle condition during stopping and engine compartment temperature may provide thermal damage to various types of components disposed in the engine compartment. With the conditions by both the determining threshold values VSPS and TAS satisfied, the radiator fan 22*a*, 22*b* are operated to forcibly scavenge the engine compartment. The respective determining threshold values VSPS, TAS are proper predetermined levels, which are obtained by previous simulation, experiment or the like and stored as a fixed data in ROM 32, in view of engine model, presence or absence of a supercharger, layout of respective components in the engine compartment and so on, for example, VSPS=10 km/h, TAS=130° C.

In the case that it is possible to scavenge the engine compartment sufficiently because of a vehicle speed equal to or higher than the predetermined speed level, namely, VSP≧VSPS in Step S4 and large blowing air volume, or in the cash that the intake air temperature is lower than the predetermined temperature level, namely, Ta<TAS in Step S5 and the engine compartment is not in a high-temperature condition, it is determined as there being unnecessary forced scavenging of the engine compartment, and Step S5 is shifted to Step S6. In Step S6, the relays RY1, RY2 are turned off to turn off (inoperative) the radiator fans 22*a*, 22*b* and complete the routine.

In the case of VSP<VSPS in Step S4 and Ta≧TAS in Step S5, namely, in the case that vehicle speed is lower than predetermined speed level, no sufficient running wind is obtained, and the intake air temperature is equal to or higher than predetermined temperature level, it is determined as there being impossible lowering of temperature in the engine compartment by means of scavenging by running wind regardless of the engine compartment in a high-temperature condition. The process proceeds to Step S7 and the radiator operating flag FLAG is set to "1" (FLAG←1), the relays RY1, RY2 are turned on in Step S8 to forcibly turn on the radiator fans 22*a*, 22*b* (operative) and complete the routine.

It is thus possible to prevent respective, components from suffering the thermal damage caused by engine compartment temperature rising excessively through scavenging the engine compartment forcibly by blowing air from the radiator fans 22*a*, 22*b*. This is effective, especially, to an engine equipped with a turbine supercharger because it tends to cause the engine compartment to be higher in temperature than a natural air intake type of engine.

After the radiator fans 22*a*, 22*b* are operated to scavenge the engine compartment, the process proceeds from Step S1 to Step S9 if FLAG=1 at the time of executing the next routine. At Step S9 it is determined whether a timer value TM for counting elapse time after operating the radiator fan reaches a preset value TMS (e.g. 600 sec.). In the case of TM<TMS, the timer value TM is counted up in Step S10 (TM←TM+1), and the relays RY1, RY2 are kept ON in Step S8 regardless of conditions such as coolant temperature, vehicle speed, and intake air temperature to continue the ON (operative) status of the radiator fans 22*a*, 22*b* and complete the routine.

When TM≧TMS is satisfied after a lapse of time, Step S9 is shifted to Step S11 to cleat the timer value TM (TM←0), and the radiator fan operating flag FLAG is cleared (FLAG←0) to complete the routine. By clearing the radiator fan operating flag FLAG, Step S1 is shifted to Step S2 with FLAG=0 at the time of executing the next routine. In the case of TM≧TMS, the radiator fan is turned on in Step S3. In the case of Tw<TWS, the radiator fan is turned on or off according to determination results in Steps S4, S5.

In other words, it is determined whether or not the engine compartment is in such a high-temperature condition as requires scavenging based on vehicle speed and intake air temperature even if the radiator fan is not operated under ordinary radiator fan control based on coolant temperature. If YES, the radiator fan is operated forcibly to scavenge the engine compartment, thus it is possible to always keep engine compartment temperature properly in addition to keeping of proper coolant temperature. It is further possible to attain a significant effect with an inexpensive system structure by changing only software processing in conventional radiator control, without any additional new device for scavenging the engine compartment.

As has been described above, in the preferred embodiment of the present invention, a multi-phase motor capable of being switched between two stages, i.e., high-speed rotation and low-speed rotation, is employed for the radiator fan. The present invention, however, is not limited thereto and may employ a simple radiator fan capable of being started and stopped with a single-phase motor.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A radiator fan controller for actuating a radiator fan of a water-cooled engine of a vehicle to control engine coolant and engine compartment temperatures, comprising:

coolant temperature determining means for comparing said engine coolant temperature (Tw) with a predetermined coolant temperature level (TWS) and for determining a low coolant temperature condition of engine coolant when said coolant temperature is lower than said predetermined coolant temperature level;

vehicle speed determining means for comparing vehicle speed (VSP) with a predetermined speed level (VSPS) and for determining a low vehicle speed condition when said vehicle speed is lower than said predetermined speed level;

engine compartment temperature determining means for comparing an engine compartment temperature (Ta) with a predetermined compartment temperature (TAS) and for determining a high temperature condition of said engine compartment when said engine compartment temperature is higher than said predetermined compartment temperature; and engine compartment scavenging means for scavenging said engine compartment by actuating said radiator fan when said engine compartment temperature determining means determines said high temperature condition, said vehicle speed determining means determines said low vehicle speed condition and said coolant temperature determining means determine said low coolant temperature condition.

2. The radiator fan controller according to claim 1, wherein said engine compartment scavenging means scavenges the engine compartment by operating the radiator fan for a predetermined period of time once said determining means determines the temperature in the engine compartment as being high enough to require scavenging of the engine compartment regardless of coolant temperature, vehicle speed, or engine compartment temperature sensed for the predetermined period of time.

3. The radiator fan controller according to claim 1, wherein said engine compartment temperature determining means comprises an intake air temperature sensor for detecting intake air temperature.

4. A method for controlling a radiator fan of a water-cooled engine of a vehicle to control engine coolant and engine compartment temperatures, comprising the steps of:

determining a low coolant temperature condition of engine coolant when said coolant temperature (Tw) is lower than a predetermined coolant temperature level (TWS);

determining a low vehicle speed condition when vehicle speed (VSP) is lower than a predetermined speed level (VSPS);

determining a high temperature condition of an engine compartment when said engine compartment temperature (Ta) is higher than a predetermined compartment temperature (TAS); and scavenging said engine compartment when the engine compartment temperature determination determines said high temperature condition, the vehicle speed determination determines said low vehicle speed condition and the coolant temperature determination determines said low coolant temperature condition.

5. The radiator fan controller according to claim 1, further comprising a multi-phase motor switchable between two stages for actuating said radiator fan in response to said engine compartment scavenging means.

* * * * *